United States Patent [19]

Tillmann

[11] Patent Number: 4,666,223

[45] Date of Patent: May 19, 1987

[54] SWITCHABLE RECEPTACLE UNIT

[75] Inventor: Ditmar K. Tillmann, Holland, Mich.

[73] Assignee: Haworth, Inc., Holland, Mich.

[21] Appl. No.: 773,089

[22] Filed: Sep. 4, 1985

Related U.S. Application Data

[63] Continuation of Ser. No. 655,996, Sep. 28, 1984, which is a continuation of Ser. No. 515,320, Jul. 19, 1983.

[51] Int. Cl.[4] ..... H01R 9/03

[52] U.S. Cl. ..... 339/32 R; 339/22 R; 200/51.06

[58] Field of Search ..... 200/51.03, 51.05, 51.06, 200/51.07; 174/48, 49; 339/18 P, 22 R, 22 B, 23, 24, 32 R

[56] References Cited

U.S. PATENT DOCUMENTS

| | | | |
|---|---|---|---|
| 1,870,762 | 8/1932 | Winter | 200/51.05 |
| 3,832,503 | 8/1974 | Crane | 200/51.07 |
| 3,993,385 | 11/1976 | Seger . | |
| 4,108,523 | 8/1978 | Bolis | 339/22 B |
| 4,367,370 | 1/1983 | Wilson et al. | 200/51.06 |
| 4,382,648 | 5/1983 | Propst et al. | 339/18 P |

*Primary Examiner*—Charles E. Phillips

*Assistant Examiner*—Renee S. Luebke

*Attorney, Agent, or Firm*—Flynn, Thiel, Boutell & Tanis

[57] ABSTRACT

A switchable power tap wherein there is provided a housing mounting therein three electrically conductive members or plates. These three plates define the electrical outlet portion of the power tap, which outlet portion in the preferred embodiment comprises a conventional electrical receptacle. The power tap also includes an electrical inlet portion which is defined by three electrically conductive prongs adapted to create a plug-like engagement with a power block. Two of the prongs are permanently electrically connected to two of the conductive plates. The third prong is part of a switch structure and is slidably supported on but in continuous electrical engagement with a conductive guide member, the latter being electrically connected to the third conductive plate. This slidable, and hence switchable, prong can be selectively positioned in any one of several different positions, three in the disclosed embodiment, so that when the power tap is plugged into the power block, the switchable prong is electrically engaged with a selected one of the three different electrical circuits provided in the power block, depending upon the preselected position of the switchable prong.

7 Claims, 12 Drawing Figures

SWITCHABLE RECEPTACLE UNIT

This application is a continuation of U.S. Ser. No. 655,996, filed Sept. 28, 1984, which was a Rule 62 continuation of Ser. No. 515,320, filed July 19, 1983.

FIELD OF THE INVENTION

This invention relates to a wall system formed from a plurality of series-connected electrically prewired panels having removable power taps and, more specifically, to an improved switchable power tap.

BACKGROUND OF THE INVENTION

U.S. Pat. No. 4,367,370, owned by the assignee of this application, discloses a wall system formed from a plurality of series-connected electrically prewired panels, and more specifically to a wall system wherein power-taps such as for light fixtures and conventional electrical receptacles can be selectively positioned on the panels and selectively switchably connected, at their point of use, to any one of a plurality of different electrical circuits. The wall system of the aforesaid patent is provided with three different electrical circuits extending therealong, and the switchable power tap is removably connected to a power block or terminal associated with the respective panel, and for this purpose a plug-in connection is provided therebetween. The power tap is provided with five conductive prongs which project into the power block for connection to the three different electrical circuits associated therewith. The power tap, however, has internal switching structure such that only one of three different prongs is connected to the output of the power tap, such as a conventional receptacle, whereby the output is hence selectively connected to only one of the three different circuits. The switching structure permits switching and hence selection between the three different circuits only when the power tap is disconnected from the power block.

The electrified wall system of the aforesaid patent, and specifically the switchable power tap associated therewith, has proven highly desirable in its ability to permit a circuit-selecting function to be performed at each individual point of use merely by manually displacing the switch associated with the respective power tap so as to permit selection of the desired circuit, following which the power tap is then plugged into its respective power block. However, in a continuing effort to improve upon the design, simplicity, function and reliability of the switchable power tap, specifically when same comprises a receptacle unit, the improved switchable power tap of this invention has hence been developed.

More specifically, this invention relates to an improved switchable power tap, specifically a receptacle unit, which is removably connectable to a power block or terminal associated with an electrically prewired wall system defined by interconnected panels, which improved power tap permits the output (that is, the receptacle) thereof to be individually selected at its point of use so as to be electrically connected to any selected one of the several electrical circuits which extend along the prewired wall panels. The improved switchable power tap of this invention permits the switching function to occur only when the power tap is electrically disconnected, and hence physically disconnected, from its respective power block. However, with this improved switchable power tap, the input to the power tap is electrically connected to only a single circuit, rather than to a plurality of circuits as with the power tap of the aforesaid patent, so that the improved power tap of this invention is in its entirety of a single electrical phase.

In addition, the improved switchable power tap of this invention is believed to provide a more reliable and more efficient switch due to its providing a more intimate electrical contact, and is believed to be less sensitive to the accuracy of the switching position. This improved power tap is also structurally simpler and less costly to manufacture.

In the improved power tap of this invention, there is provided a housing mounting therein three electrically conductive members or plates. These three plates define the electrical outlet portion of the power tap, which outlet portion in the preferred embodiment comprises a conventional electrical receptacle. The power tap also includes an electrical inlet portion which is defined by three electrically conductive prongs adapted to create a plug-like engagement with a power block. Two of the prongs are permanently electrically connected to two of the conductive plates. The third prong is part of a switch structure and is slidably supported on but in continuous electrical engagement with a conductive guide member, the latter being electrically connected to the third conductive plate. This slidable, and hence switchable, prong can be selectively positioned in any one of several different positions, three in the disclosed embodiment, so that when the power tap is plugged into the power block, the switchable prong is hence electrically engaged with a selected one of the three different electrical circuits provided in the power block, depending upon the preselected position of the switchable prong.

Other objects and purposes of the invention will be apparent to persons familiar with systems of this type upon reading the following specification and inspecting the accompanying drawings.

Figure 1:
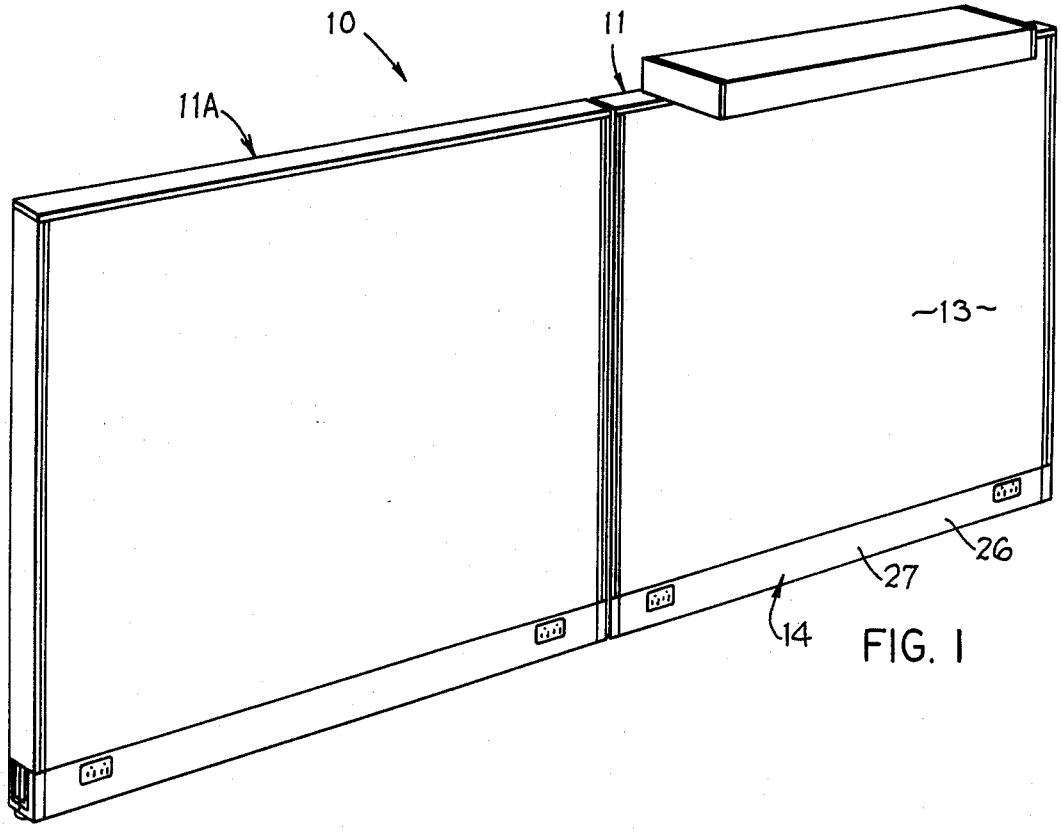
FIG. 1 is a perspective view illustrating a wall system formed from two series-connected panels which are electrically prewired.

Certain terminology will be used in the following description for convenience in reference only, and will not be limiting. For example, the words "upwardly", "downwardly", "leftwardly" and "rightwardly" will refer to directions in the drawings to which reference is made. The words "inwardly" and "outwardly" will refer to directions toward and away from, respectively, the geometric center of the panel and designated components. Said terminology will include the words specifically mentioned, derivatives thereof, and words of similar import.

DETAILED DESCRIPTION

FIG. 1 illustrates a wall system 10 formed by a series of interconnected upright prefabricated wall panels, only two substantially identical panels 11 and 11A being illustrated. Panels of different lengths can be serially interconnected.

Figure 2:
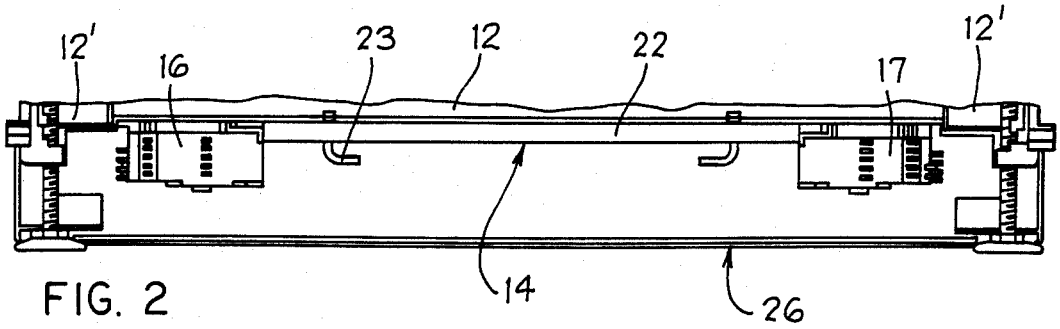
FIG. 2 is an enlarged, fragmentary view illustrating the prewired raceway, with cover removed, as associated with the lower edge of the panel.
Figure 3:
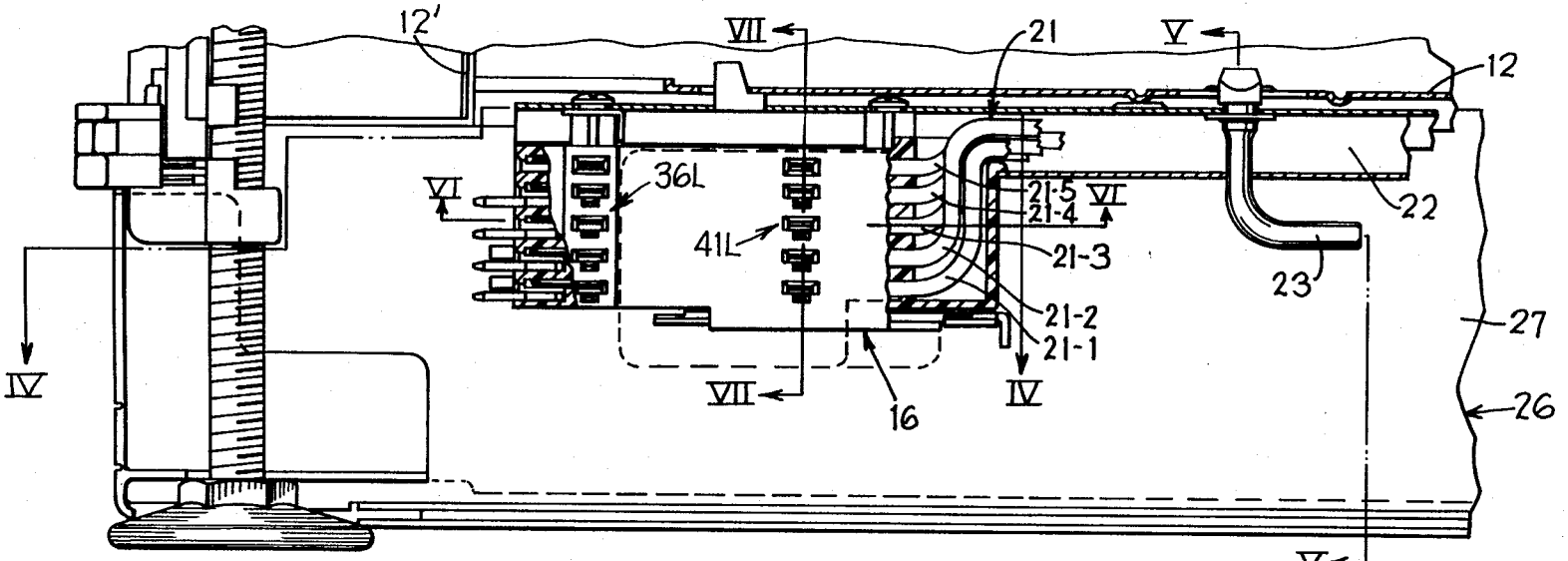
FIG. 3 is an enlarged, fragmentary, partial sectional view showing one end of the powered raceway on a single panel.

Each panel, such as panel 11, includes an internal rigid rectangular frame formed by parallel top and bottom rails rigidly joined together by parallel side rails, the bottom rail 12 and side rails 12' being partially illustrated in FIG. 2. These rails are of channel-shaped configuration and open inwardly of the panel, whereby the frame confines therein a suitable core structure, normally a honeycomb layer or similar conventional structure. The core and frame are normally sandwiched between thin facing sheets disposed on opposite sides of the frame, which sheets in turn are normally covered by a suitable fabric, the latter defining the exterior side faces 13 of the panel. The structure of panel 11 is well known, and one such structure is disclosed in U.S. Pat. No. 4,060,294, which patent also discloses the L-shaped plastic hinge used for hingedly connecting the adjacent vertical edges of two panels together.

Figure 7:
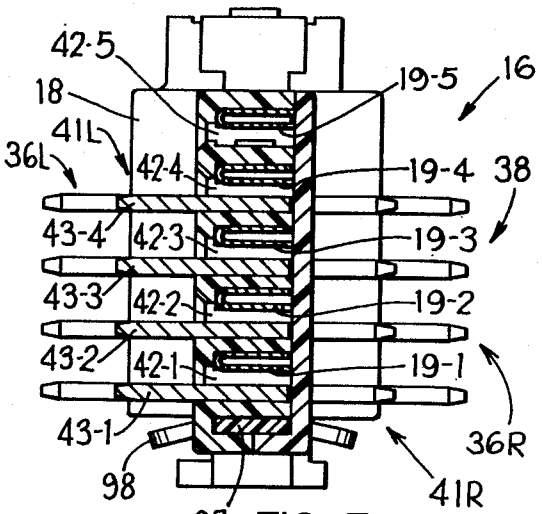
FIGS. 5–7 are enlarged sectional views as taken along lines V—V, VI—VI and VII—VII, respectively, in FIG. 3.
Figure 6:
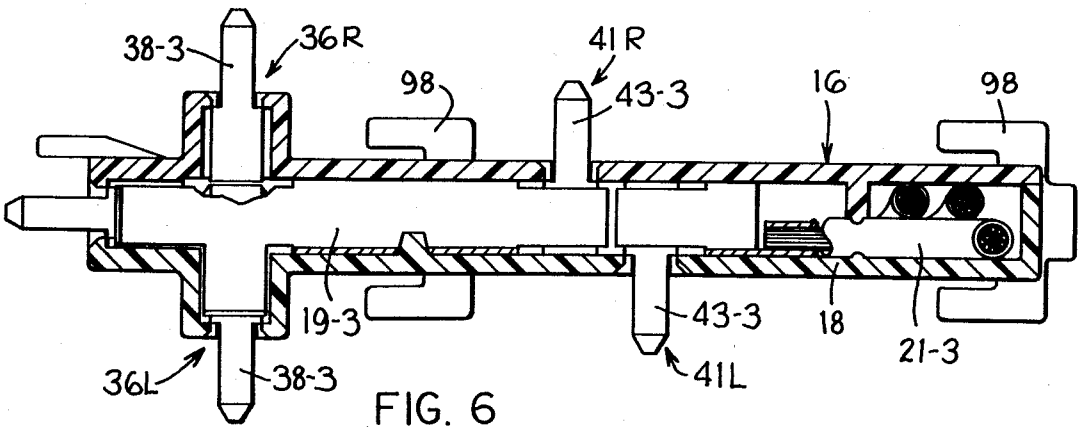

The panel 11 (as well as panel 11A) is provided with a prewired electrical system 14 extending longitudinally along the lower edge thereof, which system includes identical power blocks 16 and 17 disposed adjacent the opposite lower corners of the panel, as illustrated in FIG. 2. The power blocks 16 and 17 each include a box-like housing 18 constructed of an electrically insulative material and supporting therein five electrically conductive plates designated 19-1 through 19-5 (FIGS. 6 and 7), which plates are electrically insulated from one another. The five conductive plates 19 of power blocks 16 and 17 are individually electrically connected by five wire conductors 21 which extend between the power blocks 16 and 17, which conductors 21 extend through an elongated closed channel 22. This latter channel 22 extends between and rigidly joins the housings of the power blocks 16 and 17 together, and the channel 22 is in turn fixedly but releasably connected to the underside of the bottom frame rail 12 by means of quarter turn fasteners 23.

Figure 5:
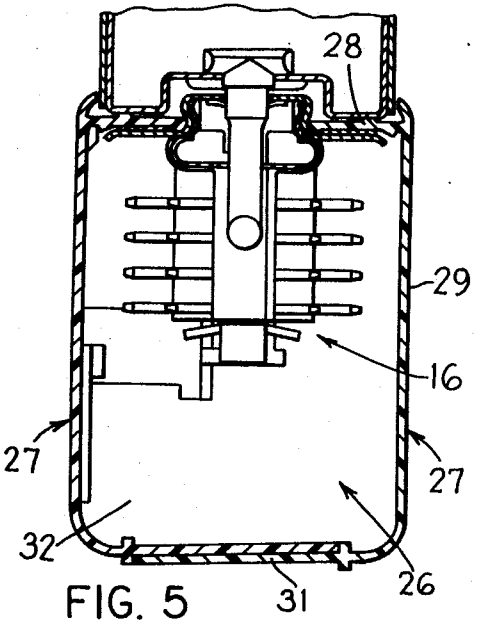

A raceway 26 is defined along the horizontally extending lower edge of the panel 11 so as to enclose the power system 14 therein. The raceway 26 is formed by a pair of substantially identical, elongated L-shaped covers 27 which cooperate with one another and with the bottom rail 12 to define a closed channel substantially as illustrated in FIG. 5. Each L-shaped cover 27 includes an upper locking tab 28 which permits the cover to be fixedly but releasably secured to the panel. Each cover also includes a vertical leg 29 which projects downwardly and is then bent inwardly to form an integral bottom leg 31. The two opposed covers 27 cooperate, when mounted on the panel, to define therein a closed passage 32 which extends longitudinally along the lower edge of the panel, which passage 32 is isolated from the wire-confining channel 22 so as to enable communication cables or the like to be fed therethrough.

Each power block 16 and 17 has a pair of identical connector portions 36 associated therewith, which portions face outwardly toward opposite sides of the power block and are identified as 36R and 36L (FIGS. 4 and 7) for purposes of identification. Each said connector portion 36 includes a set of four conductive blades or prongs 38 which project outwardly from the power block.

Figure 4:
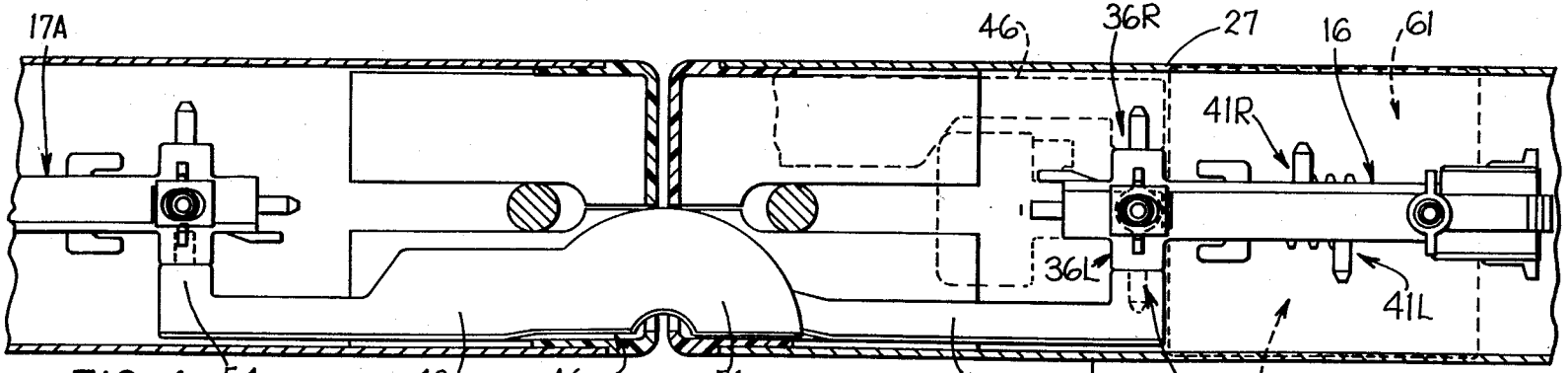
FIG. 4 is a fragmentary sectional view taken along line IV—IV in FIG. 3, but expanded to include a second panel and the electrical connector between adjacent panels.

To electrically interconnect adjacent panels such as 11 and 11A, the adjacent power blocks 16 and 17A are electrically joined by a flexible electrical connector 46 as indicated in FIG. 4. This connector 46 includes a pair of rigid housing parts 47 and 48 which have arcuate interfitting hinge portions 49 and 51 for enabling the two housing parts to be horizontally angularly displaced about an axis which is substantially aligned with the hinge axis of the hinge structure which joins the adjacent panels together. The housing parts 47 and 48 are hollow and have therein plural, here five, wires which extend therethrough for transmitting electrical energy between the identical connector portions 54 as disposed on opposite ends of the flexible connector 46.

The connector portions 54, each of which includes a set of five electrically conductive prongs, are designed for creating a plug-type electrical connection with either of the connector portions 36R or 36L as associated with the power blocks. The structure of, and cooperation between, the connector portions 38 and 54 is explained in said U.S. Pat. No. 4,367,370.

Each power block 16 and 17 also has a further pair of connector portions 41R and 41L associated with the opposite sides thereof, which connector portions are longitudinally staggered or offset relative to one another. These connector portions 41R and 41L are identical and each includes a set of five vertically spaced slots or openings 42-1 through 42-5, and a set of four conductive prongs 43-1 through 43-4 projecting outwardly of the power block housing. The prongs 43 associated with the connector portion 41L are individually separated from the prongs associated with the opposite connector portion 41R. Further, each prong 43 is separated from its respectively adjacent conductive plate 19 by means of the intermediate slot 42.

The structure described above is explained in greater detail in aforesaid U.S. Pat. No. 4,367,370.

Figure 8:
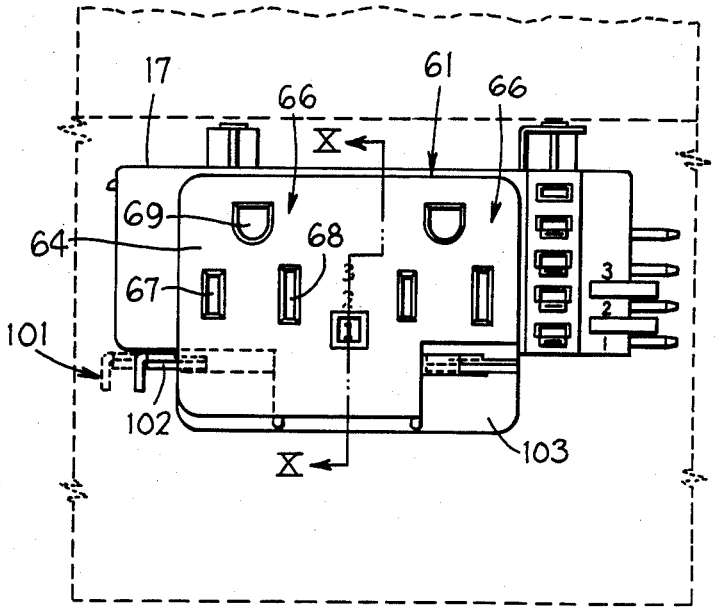
FIG. 8 is a front view showing the mounting of a power tap (i.e., a receptacle unit) on the power block, the surrounding raceway being indicated by dotted lines.
Figure 9:
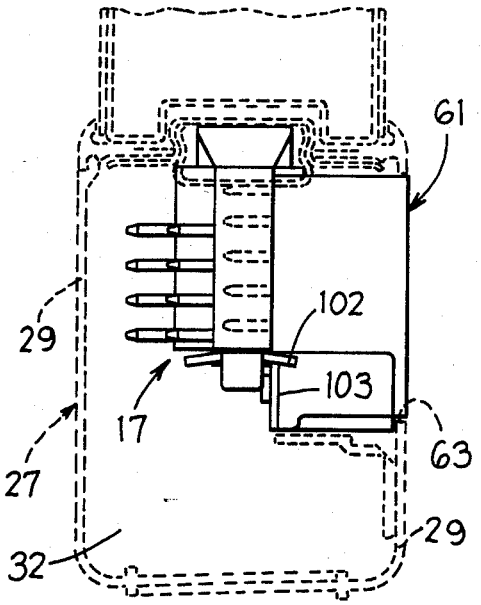
FIG. 9 is a left side view of FIG. 8.

In the wall system 10, the power blocks 16 and 17 as associated with each panel can have a power-tap unit, such as a receptacle unit 61, plugged into each or both sides thereof, whereby the receptacle unit can be positioned along the wall system at desired locations on either side thereof. This receptacle unit 61, as illustrated in FIGS. 8–9, is positionable within the raceway passage 32 so that the front face 64 of the receptacle unit is disposed substantially flush with the outer surface of the cover side wall 29, for which purpose the cover is provided with a substantially rectangular opening 63 in which the receptacle unit is positioned.

The receptacle unit 61 (FIGS. 8–12) includes a hollow block-like housing 62 constructed of a nonconductive material and having at least one outlet portion which, in the illustrated embodiment, comprises two conventional three-hole outlets or sockets 66 associated with the front face of the housing. Each socket is defined, in a conventional manner, by means of a pair of vertical slots 67 and 68 and an associated U-shaped ground slot 69 so as to accommodate any conventional two-prong or three-prong plug.

The housing 62 mounts therein a first conductive plate 73 (FIG. 11) positioned for defining the U-shaped ground slot 69, a second conductive plate 72 for defining the conductive slot 68, and a third conductive plate 71 for defining the other conductive slot 67.

Figure 10:
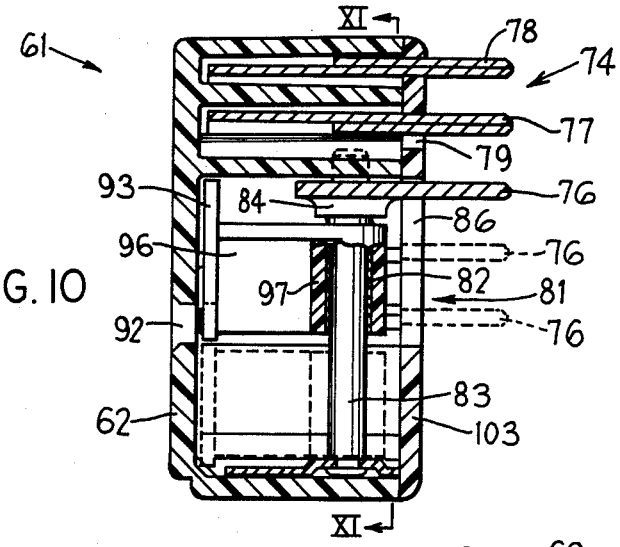
FIG. 10 is a sectional view of the power tap as taken substantially along line X—X in FIGS. 8 and 11.
Figure 11:
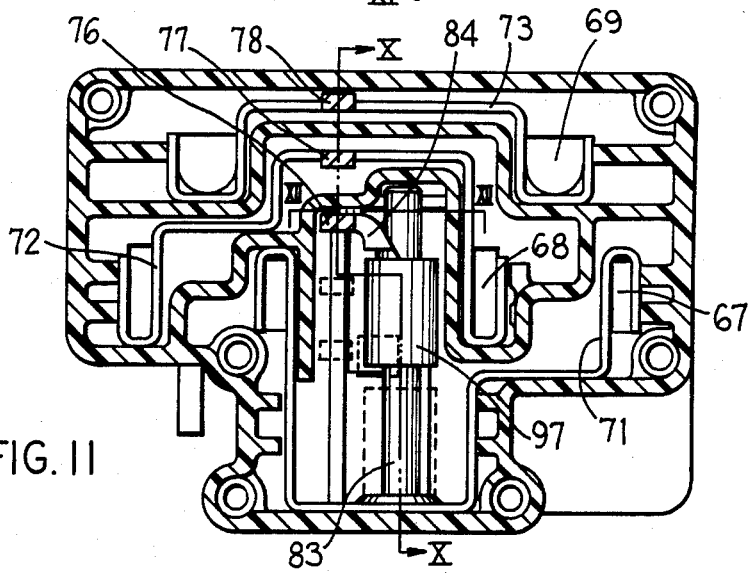
FIG. 11 is a sectional view of the power tap as taken substantially along line XI—XI in FIG. 10.
Figure 12:
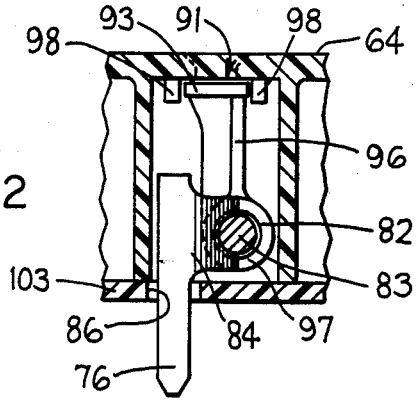
FIG. 12 is a fragmentary sectional view taken along line XII—XII in FIG. 11.

The rear of receptacle unit 61 also has an input connector portion 74 associated therewith which, as illustrated by FIG. 10, includes three conductive prongs 76 through 78. The uppermost prongs 77–78 are respectively fixedly connected to the conductive plates 72–73. The prong 77 also has a slot or opening 79 formed in the rear housing wall in direct association with the prong.

The prong 76 is associated with, and forms part of, a switch structure 81 which permits the prong 76 to be selectively positioned within one of several different positions, there being three such positions in the illustrated embodiment. This switch structure 81 includes a switching member 82 formed substantially as a sleeve and slidably supported on an elongated guide rod 83 which is fixedly positioned within the housing 61. The guide rod 83 is of electrically conductive material and has the lower end thereof fixedly secured to the conductive plate 71. The sleeve 82 is also of electrically conductive material and is snugly slidably supported on the rod 83. Sleeve 82, at its upper end, is joined to an intermediate bridging portion 84, which in turn is secured to the prong 76 so that the latter projects outwardly through the rear cover 103 of the housing in substantially perpendicular relationship to the direction of displacement of the prong. This rear cover has an elongated slot 86 through which the prong 76 projects, which slot 86 enables the prong to be slidably displaced between the three positions which are indicated in FIG. 10.

The switching means 81 also has circuit indicating means 91 associated therewith. For this purpose, the front wall of the receptacle housing 61 has a small opening or window 92 formed therein directly in front of the front face of an indicator plate 93. The front face of this indicator plate 93 has suitable indicia thereon, specifically the numerals "1", "2" and "3" so as to designate the three different electrical circuits as associated with the prewired panel. One of these latter numerals is positionable in direct alignment with the window 92 depending on the positioning of the prong 76. This indicator plate 93 is secured to the outer end of an arm 96 which, at its other end, is joined to a plastic sleeve 97 which fixedly and snugly surrounds the conductive sleeve 82. The indicator plate 93 is suitably slidably guided within a pair of guide rails 98 which are fixedly secured to the inner surface of the front wall of the housing.

OPERATION

After the wall system has been assembled as desired with the adjacent panels being electrically interconnected by flexible connectors 46, which connectors can be disposed on either side of the panels depending on the angularity between adjacent panels, then the overall system can be suitably electrified by connecting one of the power blocks to a suitable power source, whether it be floor or ceiling mounted. In this manner, electrical energy is supplied throughout the wall system, whereupon receptacle units 61 can be positioned on the panels along the wall system at selected locations. These receptacle units can be selectively switched during installation so as to be joined to any one of the three different circuits which extend along the wall system.

With respect to the receptacle unit 61, each panel can be provided with between zero and four such powertap units, since each power block can have a unit 61 plugged into either or both sides thereof. Prior to mounting of the individual receptacle unit 61 on the power block, the installer initially manually slides the switchable prong 76 upwardly or downwardly until the prong 76 is the selected one of the three different positions, which three different positions permit the receptacle unit to be electrically joined to circuit "1", "2" or "3" associated with the power block. After the prong 76 has been manually moved into the selected position, such as the uppermost position as indicated by solid lines in FIGS. 10 and 11, then the selected circuit will be visible from the front side of the receptacle unit since the selected circuit, such as the number "1", will be visible through the window 92. After the circuit selection has been made, the receptacle unit 61 is then plugged into the power block and is fixedly mounted thereon by appropriate manual slidable displacement of the locking member 101 due to the locking tabs 102 thereon overlapping a portion of the rear wall 103 of the receptacle so as to prevent it from being unplugged from the power block.

When the receptacle unit 61 is plugged into the power block, the uppermost fixed prongs 77 and 78 of the receptacle unit project into the slots 42-4 and 42-5 and hence bridge the gap which is defined interiorly of the slot so that the prongs 77 and 78 hence are in electrical engagement with the conductors 19-4 and 19-5 respectively. At the same time, the upper power block prong 43-4 projects through the slot 79 formed in the rear face of the receptacle unit. The movable prong 76, when in the illustrated uppermost position, projects into the slot 42-3 and electrically bridges between the prong 43-3 and the conductor 19-3, whereby this prong 76 is then connected to one of the circuits, such as circuit "1". The power block prong 43-3 similarly projects through the slot 86 into the receptacle unit housing and is slidably engaged with the underside of the prong 76. The remaining two prongs on the power block, namely the prongs 43-1 and 43-2, merely project through the lower portion of the slot 86 into the interior of the receptacle unit, and in particular are positioned within the void or open region defined within the interior of the receptacle unit housing. Hence, only a single circuit or electrical phase is hence transmitted from the power block to the receptacle unit 61.

In a similar fashion, when the prong 76 is switched into its middle or lowermost positions, such as for engagement respectively with circuits "2" or "3", then this prong 76 respectively projects into the power block slot 42-2 or 42-1.

After the receptacle unit has been plugged into the power block, it provides a visual indication of the selected circuit due to the positioning of the indicia plate 93 behind the window 92, thereby permitting a quick and accurate determination as to which circuits are connected to the receptacle units. However, once the receptacle unit 61 is plugged into the respective power block, then the receptacle unit cannot be switched so as to change the circuit without first causing the receptacle unit to be both physically and electrically disconnected from the power block. This hence prevents inadvertent circuit switching of the receptacle units, and hence permits safe handling and utilization of the power tap.

While the invention as described above relates specifically to a power tap formed as a receptacle unit, it will be appreciated that this power tap could also be of other forms, such as a connector for a panel-mounted light fixture or other electrical device.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an upright wall panel having an electrical terminal fixedly mounted thereon and disposed between a pair of substantially parallel vertical planes as defined by the opposite side surfaces of the panel, said panel also having an electrical cable associated therewith, said cable including a plurality of individual electrical conductors connected to said terminal so as to define at least two different electrical circuits, said terminal having a connector portion associated therewith and defined by a plurality of conductive members, said plurality of conductive members including first, second, third and fourth conductiv members, and a small portable electrical power-tap unit releasably joined to said connector portion, said power-tap unit having an inlet portion for electrical connection to said terminal and an outlet portion defining a single electrical circuit adapted for supply of electrical energy to a circuit or device disposed externally of the wall panel, the outlet portion comprising a conventional receptacle having first, second and third prong-receiving openings, said power-tap unit including first, second and third conductors which are permanently respectively electrically associated with the first, second and third prong-receiving openings, and said inlet portion of said power-tap unit including a plurality of pronglike conductive elements, said plurality of pronglike elements projecting rearwardly of the power-tap unit for creating a pluglike electrical engagement with the connector portion of said terminal, and circuit-selecting means associated with the inlet portion of said power-tap unit for permitting the inlet portion to be selectively electrically joined to either one of said two circuits but not to both at the same time, said circuit-selecting means permitting circuit selecting only when the power-tap unit is electrically disconnected from the terminal, said plurality of pronglike elements being at least one less than the number of conductive members associated with said terminal and including first, second and third said pronglike elements, said first and second pronglike elements being fixedly and electrically coupled to the first and second conductors of the power-tap unit, and said circuit-selecting menas including means for electrically but slidably supporting said third pronglike element on said third conductor of said power-tap unit for slidable displacement of said third pronglike element between first and second positions, said third pronglike element when in said first position being solely electrically coupled with the third conductive member when the power-tap unit is coupled to the terminal, and said third conductive pronglike element when in said second position bieng solely electrically coupled to the fourth conductive member when the power-tap unit is coupled to the terminal.

2. A wall panel according to claim 1, wherein said third conductor includes an elongated electrically conductive guide portion, and said third pronglike element being slidably supported on but electrically connected to said guide portion, said power-tap unit having a housing provided with an elongated slot formed in a rear wall thereof for permitting said third pronglike element to project outwardly therethrough and for accomodating the slidable displacements thereof between said first and second positions.

3. A wall panel according to claim 2, wherein said power-tap unit housing includes a front wall having an indicia-viewing opening therein, and an indicia member positioned within said housing and fixedly connected to said third pronglike element for movement therewith, said indicia member having indicia thereon which is selectively positionable behind said last-mentioned opening for determining the selected circuit.

4. In an upright wall panel having an electrical terminal fixedly mounted thereon and disposed between a pair of substantially parallel vertical planes as defined by the opposite side surfaces of the panel, said panel also having an electrical cable means associated therewith and including a plurality of individual electrical conductors connected to said terminal so as to define at least two different electrical circuits, said terminal having a connector portion associated therewith and defined by a plurality of conductive members, said plurality of conductive members including first, second, third and fourth conductive members, and a small portable electrical power-tap unit releasably joined to said connector portion, said power-tap unit having a housing, said power-tap unit having an inlet portion for electrical connection to said terminal and an outlet portion defining a single electrical circuit adapted for supply of electrical energy to a circuit or device disposed externally of the wall panel, the outlet portion comprising a conventional receptacle having first, second and third prong-receiving openings, said power-tap unit including first, second and third conductors which are permanently respectively electrically associated with the first, second and third prong-receiving openings, and said inlet portion of said power-tap unit including a plurality of conductive elements for creating a pluglike electrical engagement with the connector portion of said terminal, and circuit-selecting means associated with the inlet portion of said power-tap unit for permitting the inlet portion to be selectively electrically joined to either one of said two circuits but not to both at the same time, said circuit-selecting means permitting circuit selecting only when the power-tap unit is electrically disconnected from the terminal, said plurality of conductive elements being at least one less than the number of conductive members associated with said terminal and including first, second and third said conductive elements, said first and second conductive elements being electrically coupled to the first and second conductors of the power-tap unit, and said circuit-selecting means including means for electrically connecting said third conductive element to said third conductor of said power-tap unit and for movable displacement of said third conductive element relative to the power-tap housing between first and second positions, said third conductive element when in said first position being solely electrically coupled with the third conductive member when the power-tap unit is coupled to the terminal, and said third conductive element when in said second position being solely electrically coupled to the fourth conductive member when the power-tap unit is coupled to the terminal.

5. A wall panel according to claim 4, wherein the inlet portion of said power-tap unit includes solely three said conductive elements as defined by said first, second and third conductive elements, said three conductive elements extending generally parallel with one another and projecting transversely outwardly in the same direction away from one wall of said housing.

6. In an upright wall panel having an electrical terminal fixedly mounted thereon and disposed between a pair of substantially parallel vertical planes as defined by the opposite side surfaces of the panel, said panel also having an electrical cable means associated therewith and including a plurality of individual electrical conductors connected to said terminal so as to define at least two different electrical circuits, said terminal having a connector portion associated therewith and defined by a plurality of conductive members, said plurality of conductive members including first, second, third and fourth conductive members, and a small portable electrical power-tap unit releasably joined to said connector portion, said power-tap unit having a housing, said power-tap unit having an inlet portion for electrical connection to said terminal and an outlet portion defining a single electrical circuit adapted for supply of electrical energy to a circuit or device disposed externally of the wall panel, the outlet portion comprising a conventional receptacle having first, second and third prong-receiving openings, said power-tap unit including first, second and third conductors which are permanently respectively electrically associated with the first, second and third prong-receiving openings, said inlet portion of said power-tap unit including a plurality of conductive elements for creating a pluglike electrical engagement with the connector portion of said terminal, and circuit-selecting means associated with the inlet portion of said power-tap unit for permitting the inlet portion to be selectively electrically joined to either one of said two circuis but not to both at the same time, said circuit-selecting means permitting circuit selecting only when the power-tap unit is electrically disconnected from the terminal, said plurality of conductive elements being at least one less than the number of conductive members associated with said terminal and including first, second and third said conductive elements, said first and second conductive elements being electrically coupled to the first and second conductors of the power-tap unit, and said circuit-selecting means including means for electrically connecting said third conductive element to said third conductor of said power-tap unit and for movable displacement of said third conductive element relative to the power-tap housing between first and second positions, said third conductive element when in said first position being solely electrically coupled with the third conductive member when the power tap unit is coupled to the terminal, and said third conductive element when in said second position being solely electrically coupled to the fourth conductive member when the power-tap unit is coupled to the terminal, said third conductor including an elongated electrically conductive guide portion, and said third conductive element being slidably supported on and electrically connected to said guide portion, said power-tap unit housing having an elongated slot formed in a rear wall thereof for permitting said third conductive element to project outwardly therethrough and for accommodating the slidable displacement thereof between said first and second positions.

7. In an upright wall panel having an electrical terminal fixedly mounted thereon and disposed between a pair of substantially parallel vertical planes as defined by the opposite side surfaces of the panel, said panel also having an electrical cable means associated therewith and including a plurality of individual electrical conductors connected to said terminal so as to define at least two different electrical circuits, said terminal having a connector portion associated therewith and defined by a plurality of conductive members, said plurality of conductive members including first, second, third and fourth conductive members, and a small portable electrical power-tap unit releasably joined to said connector portion, said power-tap unit having a housing, said power-tap unit having an inlet portion for electrical connection to said terminal and an outlet portion defining a single electrical circuit adapted for supply of electrical energy to a circuit or device disposed externally of the wall panel, the outlet portion comprising a conventional receptacle having first, second and third prong-receiving openings, said power-tap unit including first, second and third conductors which are permanently respectively electrically associated with the first, second and third prong-receiving openings, said inlet portion of said power-tap unit including a plurality of conductive elements for creating a pluglike electrical engagement with the connector portion of said terminal, and circuit-selecting means associated with the inlet portion of said power-tap unit for permitting the inlet portion to be selectively electrically joined to either one of said two circuits but not to both at the same time, said circuit-selecting means permitting circuit selecting only when the power-tap unit is electrically disconnected from the terminal, said plurality of conductive elements being at least one less than the number of conductive members associated with said terminal and including first, second and third said conductive elements, said first and second conductive elements being electrically coupled to the first and second conductors of the power-tap unit, and said circuit-selecting means including means for electrically connecting said third conductive element to said third conductor of said power-tap unit and for movable displacement of said third conductive element relative to the power-tap housing between first and second positions, said third conductive element when in said first position being solely electrically coupled with the third conductive member when the power-tap unit is coupled to the terminal, and said third conductive element when in said second position being solely electrically coupled to the fourth conductive member when the power-tap unit is coupled to the terminal, the plurality of individual electrical conductors associated with said cable means defining at least three different electrical circuits, said terminal having a fifth conductive member associated therewith and connected to said cable means for defining said third circuit, and said circuit-selecting means supporting said third conductive element for slidable movement relative to the power-tap unit housing into a third position wherein the third conductive element is solely electrically coupled to the fifth conductive member when the power-tap unit is coupled to the terminal.

* * * * *